US005136750A

United States Patent [19]

Takashima et al.

[11] Patent Number: 5,136,750

[45] Date of Patent: Aug. 11, 1992

[54] VACUUM CLEANER WITH DEVICE FOR ADJUSTING SENSITIVITY OF DUST SENSOR

[75] Inventors: Yoshinori Takashima, Oomihachiman; Toshiichiro Tanaka, Youkaichi, both of Japan

[73] Assignee: Matsushita Electric Industrial Co., Ltd., Osaka, Japan

[21] Appl. No.: 724,489

[22] Filed: Jun. 28, 1991

Related U.S. Application Data

[63] Continuation of Ser. No. 432,008, Nov. 6, 1989, abandoned.

[30] Foreign Application Priority Data

Nov. 7, 1988 [JP] Japan ..... 63-280805

[51] Int. Cl.[5] ..... A47L 9/28

[52] U.S. Cl. ..... 15/319; 15/339; 15/377; 250/574; 356/438

[58] Field of Search ..... 356/338, 342, 343, 439

[56] References Cited

U.S. PATENT DOCUMENTS

| | | | |
|---|---|---|---|
| 3,579,706 | 5/1971 | Hetland | 15/377 |
| 3,588,943 | 6/1971 | Hetland | 15/377 |
| 4,580,311 | 4/1986 | Kurz | 15/319 |
| 4,601,082 | 7/1986 | Kurz | 15/319 |
| 4,611,365 | 9/1986 | Komatsu et al. | 15/339 |
| 4,654,924 | 4/1987 | Getz et al. | 15/319 |
| 4,680,827 | 7/1987 | Hummel | 15/319 |
| 4,767,213 | 8/1988 | Hummel | 15/339 X |
| 4,920,605 | 5/1990 | Takashima | 15/319 |
| 4,942,640 | 7/1990 | Hayashi et al. | 15/319 |
| 4,977,639 | 12/1990 | Takahashi et al. | 15/319 |

FOREIGN PATENT DOCUMENTS

| | | | |
|---|---|---|---|
| 0312111 | 4/1989 | European Pat. Off. | 15/319 |

*Primary Examiner*—Timothy F. Simone
*Assistant Examiner*—C. Cooley
*Attorney, Agent, or Firm*—Pollock, VandeSande & Priddy

[57] ABSTRACT

A vacuum cleaner with a dust sensor comprising a light-emitting element and a light-receiving element for receiving light emitted from the light-emitting element. The dust sensor is provided in a suction passage between a suction nozzle and a dust collector of the vacuum cleaner for detecting dust in air drawn through the suction nozzle to generate a current corresponding to the detection result. A manual switch decreases sensitivity to dust detection while a rotatable member cleans a carpet. This prevents variations in dust detection from influencing operation of the rotatable cleaning member.

3 Claims, 3 Drawing Sheets

VACUUM CLEANER WITH DEVICE FOR ADJUSTING SENSITIVITY OF DUST SENSOR

This application is a continuation of Ser. No. 432,008, filed on Nov. 6, 1989, now abandoned.

BACKGROUND OF THE INVENTION

The present invention relates generally to vacuum cleaners, and more particularly to a sensitivity adjusting apparatus of a dust sensor for use in such a vacuum cleaner.

Known is a vacuum cleaner with a dust sensor provided in an air passage between a suction opening and a dust collecting device. When dust is included in the drawn air, the dust sensor senses the dust and indicates the presence of the dust by means of an indication lamp, for example, and heightens the rotational speed of an electrical blower for a predetermined time period. However, for adequate cleaning, the adjustment of the sensitivity of the dust sensor is required in accordance with the kind of object to be cleaned by the vacuum cleaner. For example, when cleaning a shaggy carpet, the dust detection sensitivity is required to be lowered as compared with the sensitivity for a board floor, because the dust sensor tends to detect the pile of the shaggy carpet as dust.

SUMMARY OF THE INVENTION

It is therefore an object of the present invention to provide a vacuum cleaner with a dust sensor which is adjustable in sensitivity in accordance with the kind of object to be cleaned by the vacuum cleaner.

In accordance with the present invention, there is provided a vacuum cleaner comprising dust sensor means for detecting dust in air drawn through a suction nozzle of the vacuum cleaner to generate a current corresponding to the result of the detection and adjusting means coupled to the dust sensor means including resistor means to change the value of the current generated by the dust sensor means.

Preferably, the dust sensor means comprises a light-emitting element and a light-receiving element for producing a signal corresponding to the intensity of the light emitted from the light-emitting element, the light-emitting element and light-receiving element being provided in a suction passage provided between the suction nozzle and dust collecting means of the cleaner.

In accordance with the present invention, there is further provided a vacuum cleaner with a rotatable member which is housed in a suction nozzle and which is operated by an electric motor driven by to a power source in response to a closing operation of a first switch, the vacuum cleaner comprising dust sensor means for detecting dust in air drawn through the suction nozzle and adjusting means coupled to the dust sensor means for adjusting the sensitivity of the dust sensor means for the dust detection. The adjusting means includes resistor means and a second switch which are coupled in parallel to each other so that the second switch shorts the resistor means when entering into a closed state, the second switch being coupled to the first switch so as to be operable in accordance with the operation of the first switch.

BRIEF DESCRIPTION OF THE DRAWINGS

The object and features of the present invention will become more readily apparent from the following detailed description of the preferred embodiment taken in conjunction with the accompanying drawings in which.

DETAILED DESCRIPTION OF THE INVENTION

Figure 1:
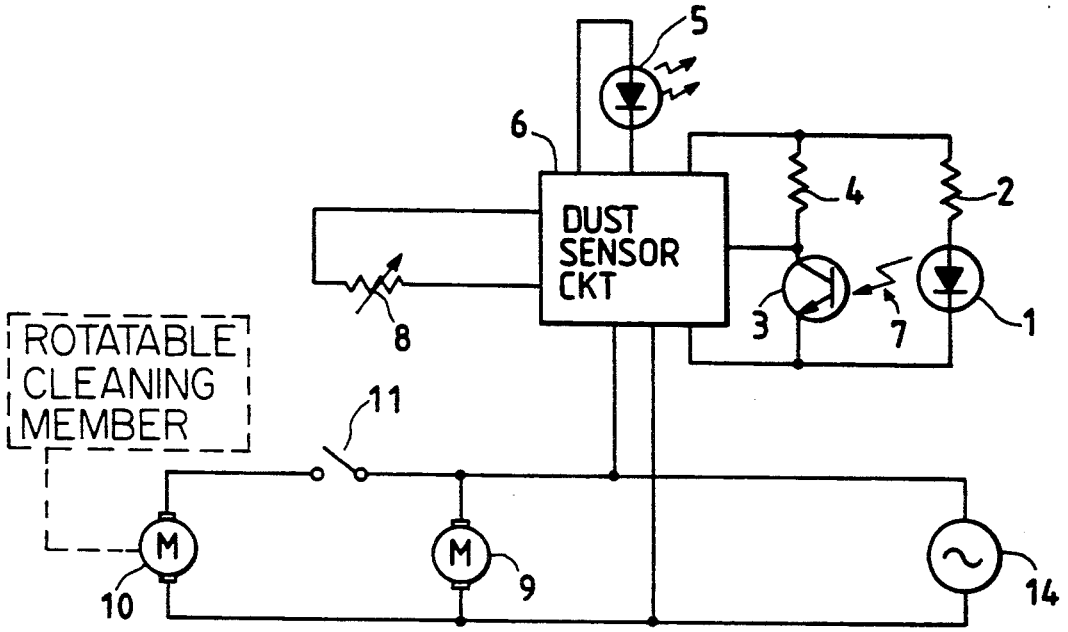
FIG. 1 is a circuit diagram showing a circuit arrangement for use in a vacuum cleaner according to a first embodiment of the present invention.

Referring now to FIG. 1, there is illustrated a circuit arrangement to be used in a vacuum cleaner according to a first embodiment of the present invention. In FIG. 1, the circuit arrangement includes a dust sensor 7 comprising an infrared light-emitting diode (LED) 1 which emits infrared light and a phototransistor 3 which produces a current corresponding to the light emerging from the infrared LED 1. The output of the phototransistor 3 is led into a dust sensor circuit 6. Numeral 2 represents a resistor for determining the current to be introduced into the infrared LED 1 and numeral 4 designates a load resistor for the phototransistor 3. In response to rotation of a fan motor 9 coupled to a power source 14, air is drawn into the suction passage, and when dust is included in the drawn air, the infrared light from the infrared LED 1 is interrupted and the dust sensor circuit turns on an indication lamp 5. The dust sensor circuit 6 is coupled to a variable resistor 8 whose resistance is varied by the user so as to adjust the sensitivity of detection of the drawn dust. Numeral 10 depicts an electric motor for driving an agitator such as a rotatable brush of the vacuum cleaner, as represented by the dotted box entitled rotatable cleaning member, which is driven by operation of a switch 11.

Figure 2:
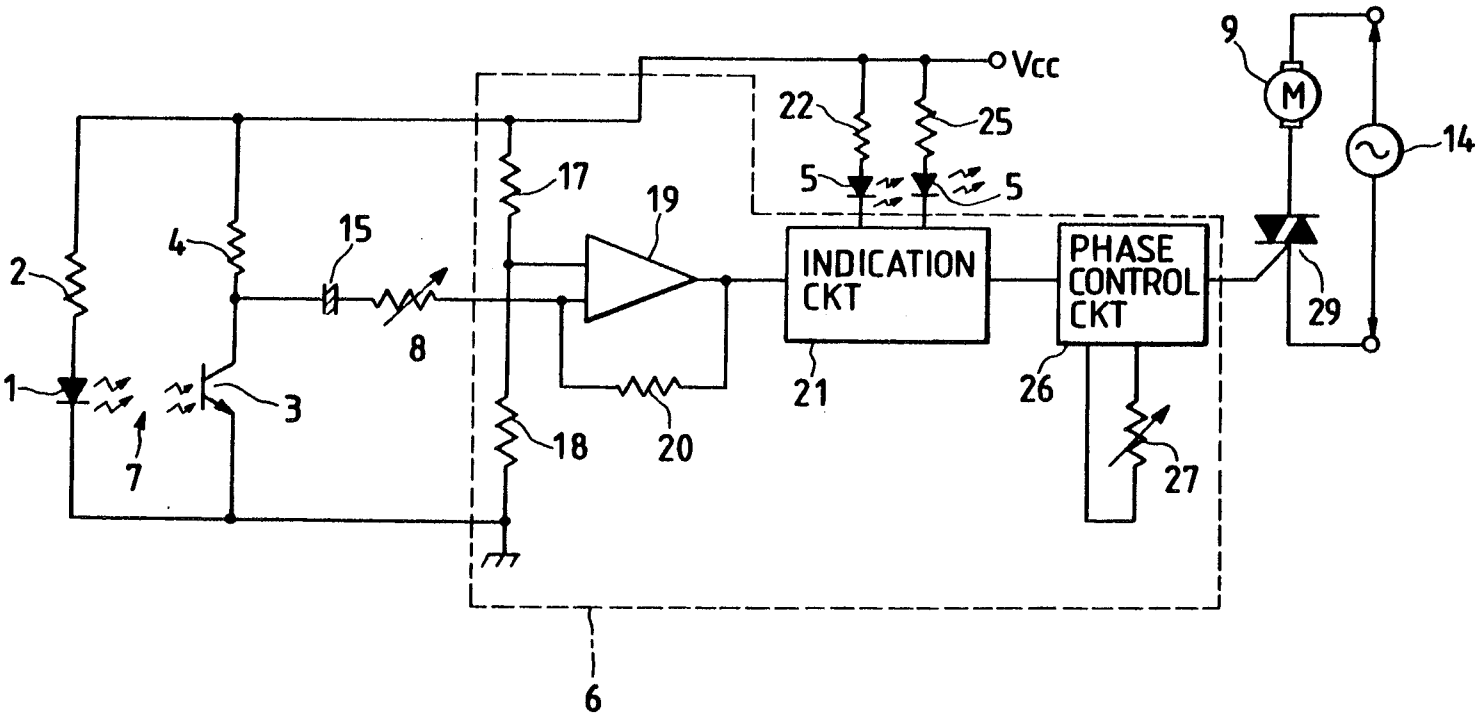
FIG. 2 is a more detailed illustration of the FIG. 1 circuit arrangement.

FIG. 2 is an illustration of a more detailed arrangement of the circuit illustrated in FIG. 1. In FIG. 2, the signal (current) determined by the phototransistor 3 is supplied through a capacitor 15, which is provided to extract only the alternating-current component of the current due to the phototransistor 3, and the variable resistor 8 to an operational amplifier 19. The amplification degree of the operational amplifier 19 depends upon the resistance value of the variable resistor 8 and a resistor 20, and therefore, changing the resistance value of the variable resistor 8 causes variation of the amplification degree of the operational amplifier 19. The dust detection sensitivity becomes higher in accordance with increase in the amplification degree of the operational amplifier 19. Thus, the dust detection sensitivity is adjustable by means of the control of the resistance value of the variable resistor 8. The output of the operational amplifier 19 is supplied to an indication circuit 21 for driving the indication lamp 5 and is further led to a phase control circuit 26 for driving a bidirectional thyrister 29 to control the speed of the fan motor 9. A variable resistor 2 is also coupled to the phase control circuit 26 so as to perform the phase control. In FIG. 2, numerals 17, 18, 22 and 25 respectively represent resistors.

Figure 3:
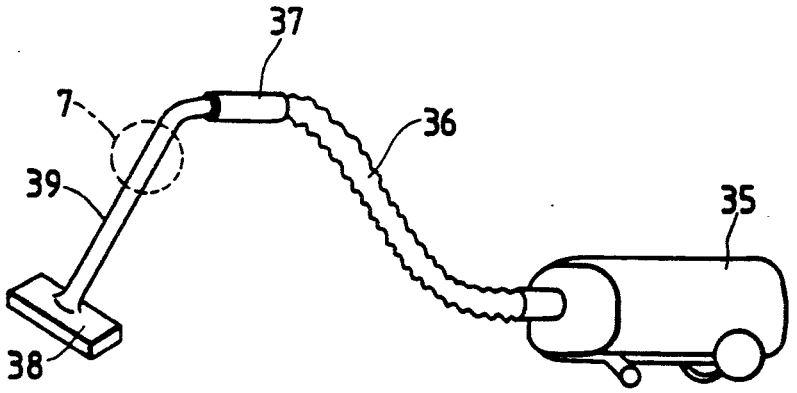
FIG. 3 is a perspective view of a vacuum cleaner having a dust sensor in a suction passage.
Figure 4:
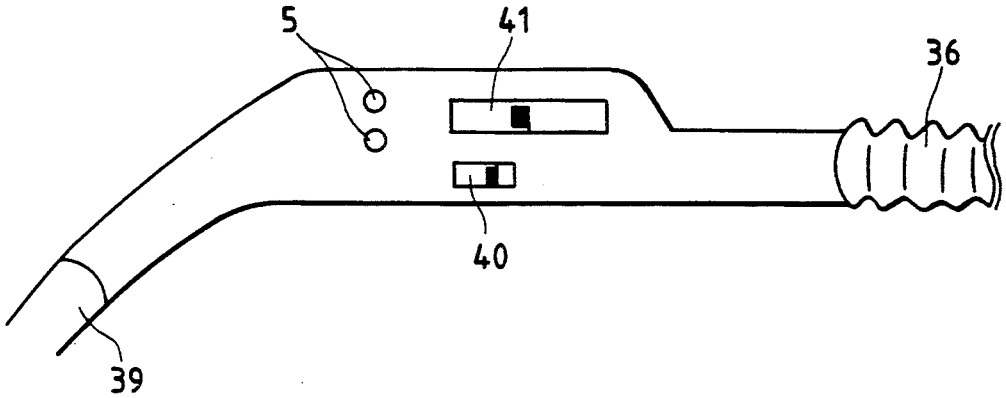
FIG. 4 is an illustration of an operating section of the FIG. 3 vacuum cleaner.

The dust sensor 7, as illustrated in FIG. 3, is provided in a suction passage between a suction nozzle 38 and an operating section 37 of the vacuum cleaner, the operating section 37 being coupled through a hose 36 to a body 35 of the vacuum cleaner having therein the fan motor 9. As illustrated in FIG. 4, on the operating section 37 are provided an adjusting device 40 operatively coupled to the variable resistor 8 for adjusting the resistance value of the variable resistor 8 and another adjusting device 41 operatively coupled to the variable resistor 27 for adjusting the resistance value of the variable resistor 27.

Figure 5:
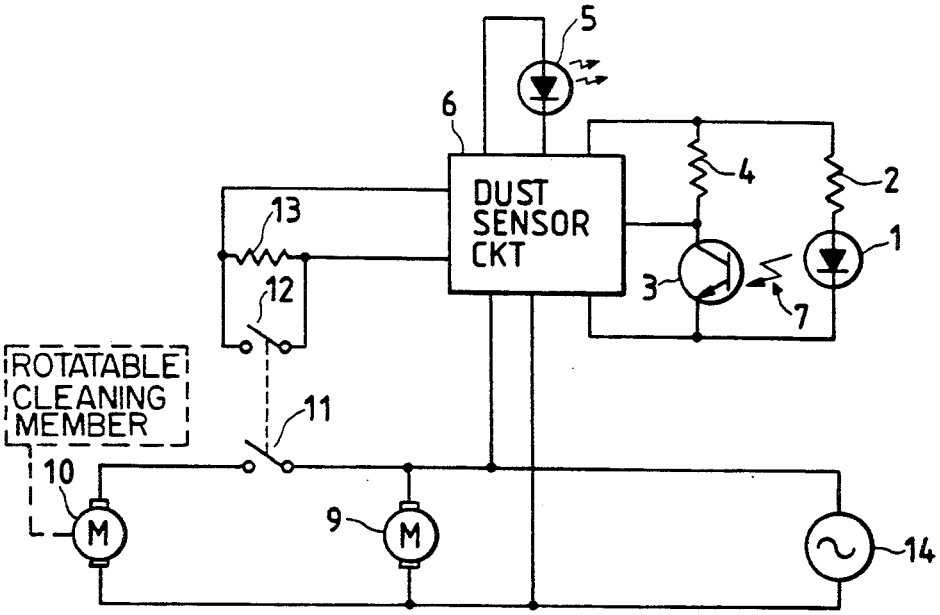
FIG. 5 is a circuit diagram showing a vacuum cleaner circuit arrangement including a function of automatically adjusting the sensitivity of detection of dust drawn into a vacuum cleaner according to a second embodiment of this invention.

Referring now to FIG. 5, there is illustrated a circuit arrangement of a vacuum cleaner according to a second embodiment of the present invention, where parts corresponding to those in FIG. 1 are marked with the same numerals. In FIG. 5, the circuit arrangement of this embodiment includes a dust sensor 7 which is composed of an infrared light-emitting diode (LED) 1 for emitting infrared light and a phototransistor 3 for producing a current corresponding to the intensity of the light emerging from the infrared LED 1. The output of the phototransistor 3 is led into a dust sensor circuit 6. Numeral 2 represents a resistor for determining the current to be introduced into the infrared LED 1 and numeral 4 designates a load resistor for the phototransistor 3. In accordance with a signal from the dust sensor circuit 6, an indication lamp 5 turns on so as to indicate the presence of dust in the air drawn into the suction passage. Numeral 9 designates a fan motor driven due to a power source 14 and numeral 10 depicts an electric motor for an agitator of the vacuum cleaner which is driven by operation of a switch 11. Also included in the circuit arrangement are a switch 12 and a resistor 13 which are respectively coupled to the dust sensor circuit 6. The switch 12 is a change-over switch for adjusting the sensitivity of the dust sensor circuit 6 for dust detection and the resistor 13 is provided in order to set the detection sensitivity of the dust sensor circuit 6. The change-over switch 12 is connected in parallel to the resistor 13 and is mechanically connected to the switch 11 for operation of the agitator driving motor 10, so as to be operated in connection with the operation of the switch 11. The switch 11 may be provided on the operating section 37. The rotatable-brush driving motor 10 is operated when cleaning a carpet and stopped when cleaning the other objects such as a bare floor.

In response to the closing operation of the switch 11 for the driving of the motor 10 made when cleaning a carpet, the change-over switch 12 automatically enters into the closed state because of the mechanical connection therebetween. The closing of the change-over switch 12 causes the short of the resistor 13, thereby resulting in lowering the detection sensitivity of the dust sensor circuit 6. That is, the detection sensitivity of the dust sensor circuit 6 is automatically lowered due to the operation of the switch 11 made when cleaning a carpet.

It should be understood that the foregoing relates to only preferred embodiments of the present invention, and that it is intended to cover all changes and modifications of the embodiments of this invention herein used for purposes of the disclosure, which do not constitute departures from the spirit and scope of this invention.

What is claimed is:

1. A vacuum cleaner with a rotatable cleaning member driven by a motor and housed in a suction nozzle which contacts an object to be cleaned, the motor being turned on upon closing of a first switch, the vacuum cleaner comprising:

dust sensor means for detecting dust in air drawn through the suction nozzle;

shortable resistance means connected to the dust sensor means for adjusting the dust detection sensitivity of said dust sensor means;

means for coupling the resistance means to the first switch for decreasing the sensor sensitivity upon closing of the first switch; and means connected to the output of the sensor means for indicating the presence of intake dust.

2. A vacuum cleaner as claimed in claim 1, wherein said dust sensor means comprises a light-emitting element and a light-receiving element for producing a signal corresponding to the intensity of the light emitted from said light-emitting element, said light-emitting element and said light-receiving element are provided in a suction passage provided between said suction nozzle and dust collecting means of said cleaner.

3. A vacuum cleaner as set forth in claim 1, wherein said resistance means comprises:

a resistor; and a second switch connected across the resistor;

wherein the coupling means closes the second switch upon closing of the first switch thereby shorting the resistor and decreasing the sensor means sensitivity simultaneously with an operation of the rotatable member.

* * * * *